US005448847A

United States Patent [19]

Teetzel

[11] Patent Number: 5,448,847

[45] Date of Patent: Sep. 12, 1995

[54] WEAPON LOCK AND TARGET AUTHENTICATING APPARATUS

[76] Inventor: James W. Teetzel, 14 Stratham Green, Stratham, N.H. 03885

[21] Appl. No.: 275,128

[22] Filed: Jul. 14, 1994

[51] Int. Cl.[6] ..... F41A 17/08; F41A 17/06

[52] U.S. Cl. ..... 42/70.11; 42/70.05; 42/70.06

[58] Field of Search ..... 42/70.08, 70.06, 70.05, 42/70.01, 70.11, 66

[56] References Cited

U.S. PATENT DOCUMENTS

| | | | |
|---|---|---|---|
| 3,838,533 | 10/1974 | Ruger | 42/66 |
| 4,003,152 | 1/1977 | Barker et al. | 42/70.01 |
| 4,488,370 | 12/1984 | Lemelson | 42/70.01 |
| 4,563,827 | 1/1986 | Heltzel | 42/70.01 |
| 4,682,435 | 7/1987 | Heltzel | 42/70.01 |
| 5,192,818 | 3/1993 | Martin | 42/70.01 |

FOREIGN PATENT DOCUMENTS

| | | | |
|---|---|---|---|
| 682124 | 10/1939 | Germany | 42/70.06 |
| 3446019 | 6/1986 | Germany | 42/70.11 |

*Primary Examiner*—Stephen M. Johnson
*Attorney, Agent, or Firm*—William B. Ritchie

[57] ABSTRACT

A lock and target authentication apparatus for handguns and rifles. The apparatus is designed to fit into handgrips that replace the factory provided handgrips. Flexible membrane circuitry is contained within the handgrips as well as the power source for the apparatus so that the unit does not have to made part of the weapon and can easily be added afterward. The only other modification of the weapon that is necessary is to make a slight change to the trigger assembly or trigger bar. An infra red signal is communicated from a remote transmitter that unlocks a solenoid mechanism that prevents the weapon from being fired. The signal is unique to the weapon. The apparatus also features a target authentication ability so that a number of weapons can communicate with one another to prevent a weapon from being fired at them if that weapon receives a preselectable infra red signal that indicates to the apparatus that the other weapon is a "friend" and not a "foe".

5 Claims, 4 Drawing Sheets

WEAPON LOCK AND TARGET AUTHENTICATING APPARATUS

BACKGROUND OF THE INVENTION

1. Field of the Invention

The invention relates to electronic gun locks and friendly/foe systems, particularly electronic systems for small arms.

2. Description of the Related Art

The need for a reliable lock for a handgun or rifle or shotgun has never been more accurate. With numbers of guns owned by citizens increasing at a substantial rate and the fire power of these weapons becoming greater, a loaded firearm in the hands of a minor or unauthorized person often results in catastrophic consequences. Typical safety mechanisms such as trigger locks are difficult to remove quickly which makes them unsuitable for locking firearms which must be ready for use at a moment's notice.

U.S. Pat. No. 5,168,114, issued to Enget on Dec. 1, 1992, discloses an automatic gun safety device consisting of a mechanism for transmitting radio signals and a receiver attached to the weapon. A solenoid is electrically connected to the receiving mechanism. The solenoid normally engages the trigger of the firearm, so that the firearm can only be fired when the transmitting mechanism is in range of the receiving mechanism and a properly coded signal is being received by the receiving mechanism.

U.S. Pat. No. 4,488,370, issued to Lemelson on Dec. 18, 1984, discloses another form of electronic locking apparatus for firearms. This device comprises a passive electronic circuit which is worn on the arm or finger of the person authorized to use the weapon. The system is activated by field energy generated by an electronic circuit supported in the weapon, and generates a signal or code which is short wave transmitted to the weapon's electronic circuit. Once the control signal is generated, a motor or solenoid drives a latch or stop mechanism within the firearm to disable it. U.S. Pat. No. 4,467,545, issued to Shaw, Jr. on Aug. 28, 1984, discloses a safety device responsive to the palm or fingerprint of one or more individuals authorized to fire the weapon. This particular safety device is activated by a heat sensor when the device is held in the hand. Unless the palm or finger print of the person holding the device matches a pre-stored pattern, a blocking safety mechanism normally preventing operation of the weapon, is maintained in its "blocking slate" and the weapon will not fire.

U.S. Pat. No. 5,016,376, issued to Pugh on May 21, 1991, discloses still another variation of an electronic safety lock for small arms. This disclosure teaches the use of a solenoid actuated or deactuated upon the application of an electronic signal connected to a decoder. A magnetized ring or microchip bearing ring enables authorized users to operate the handgun.

U.S. Pat. No. 5,062,232, issued to Eppler on Nov. 5, 1991, discloses still another safety device for firearms. In this particular disclosure, a code generator is worn on the finger or palm. The code generator can be a microchip, bar code, etc., which is read by a detector in the handgun so that only authorized users can operate the trigger.

U.S. Pat. No. 5,022,175, issued to Oncke, et al. on Jun. 11, 1991, discloses a safety arrangement for selectively disabling a firearm. This patent teaches the use of a key pad having a plurality of key buttons which must be pushed in the proper sequence in order to unlock the gun. The gun is locked by means of a rod slidably mounted in the handle and adapted to move relative to the, hammer, thereby causing the hammer to be locked unless the proper signal is provided to unlock the gun.

U.S. Pat. No. 3,939,679, issued to Barker, et al. on Feb. 24, 1976, discloses still another solenoid activated switching mechanism for disabling a firearm. The solenoid is electrically connected to a signal receiver and decoder, which must receive the proper signal from an external energizer and encoder in order to send the proper release signal to the solenoid.

All of the above devices must be intricately incorporated as part of the weapon and, therefore, are extremely difficult to retrofit to existing firearms. Moreover, they are all shown to be used strictly with handguns and would not lend themselves to be easily modified to fit within a rifle.

Law enforcement agencies and the military face a related problem that is not solved or considered by the other referenced devices. That problem is the friend/foe issue that often results in friendly force being accidently wounded or even killed by their comrades in arms. During a fire fight, it is extremely easy to make a mistake, due to the stress and haste of the activity, concerning a proper target versus an incorrect target. Despite advances in electronic devices for aircraft, tanks, etc. concerning friend/foe identification, nothing has been developed for infantry personnel or for local law enforcement officers. Situations as the shoot out in Waco, Tex. amplify the need for an officer to be certain that his target is not a "friend" before the weapon is discharged.

Therefore, there is a long felt need for an apparatus that combines the ability to lock either a handgun or a rifle as a safety mechanism to prevent unauthorized personnel from firing the weapon. There is also a long felt need for an apparatus that can be used to automatically prevent the weapon from being fired if it is aimed at a "friend" during a combat situation yet enable the weapon to be fired when aimed at a "foe". It would also be beneficial if this apparatus could utilize the infra red laser sighting system that is found on many handguns and rifles today. An apparatus as described that can be easily adapted to fit a variety of sizes and types of handguns or rifles, and that can be retrofitted to existing weapons requiring little modification of the weapon other replacing the handgrips is not disclosed in the prior art.

SUMMARY OF THE INVENTION

It is an object of the invention to provide a weapon lock and target authenticating apparatus that can be activated using an infra red signal from an authorized user.

It is another object of the invention to provide a weapon lock and target authenticating apparatus that can contained within the handgrips that correspond to the size and shape of those provided with the weapon at the time of manufacture.

It is still another object of the invention to provide a weapon lock and target authenticating apparatus that can utilize an infra red laser sighting system in order to provide a target authenticating ability to the apparatus.

Another object of the invention is to provide a weapon lock and target authenticating apparatus that can be programmed so that the weapon cannot fire at targets which send back the same programmed code.

It is still another object of the invention to provide a weapon lock and target authenticating apparatus that features a unique emitter that corresponds to the serial number of the weapon.

It is still another object of the invention to provide a weapon lock and target authenticating apparatus with a "wake up" feature that is activated when a hand contacts the grips so that the battery power is conserved.

Another object of the invention is to provide a weapon lock and target authenticating apparatus that can also be activated by a motion detector contained within a flexible circuit inside the handgrips that replace the factory installed grips.

It is still another object of the invention to provide a weapon lock and target authenticating apparatus that has a solenoid locking mechanism that prevents the weapon from firing unless it is unlocked by the proper infra red signal.

Another object of the invention is to provide a weapon lock and target authenticating apparatus that utilizes flexible circuits completely contained within the handgrips that attaches to the gun frame.

It is still another object of the invention to provide a weapon lock and target authenticating apparatus that features handgrips that are positioned with screws requiring a special wrench so that the apparatus cannot be removed or tampered with.

Finally, it is an object of the invention to provide a weapon lock and target authenticating apparatus that can communicate via infra red signals with another weapon, similarly equipped, so that if both weapons are programmed with the same code, which can be easily changed from time to time, the weapons will be prevented from firing at one another.

The invention is a lock and target authenticating apparatus for a weapon having a trigger that, when pulled, activates a discharge assembly causing said weapon to discharge. Self-contained, remote infra red emitter means, located at a distance from said weapon, for emitting a unique infra red signal that corresponds only to said weapon is provided. Infra red sensing means for detecting the signal emitted by said emitter means, wherein said sensing means is attached to said weapon is provided. Locking means, connected to the discharge assembly of said firearm, for preventing the activation of said weapon when said trigger is pulled is also provided. Central processing means, connected to said sensing means and said locking means, for evaluating the signal received by said sensing means to verify that it corresponds only to that weapon is provided. Said central processing means causes said locking means to unlock when the signal received by said sensing means is verified. Internal infra red emitter means, connected to said central processing means, is provided for sending a unique selectable infra red authentication signal wherein when said authentication signal is detected by a different weapon equipped with said apparatus via its infra red sensing means, said central processing means of said different weapon causes said locking means of said different weapon to lock which cannot be overridden by said self-contained, remote infra red emitter means corresponding to said different weapon as long as said authentication signal is being detected.

DETAILED DESCRIPTION OF THE INVENTION

Figure 1:
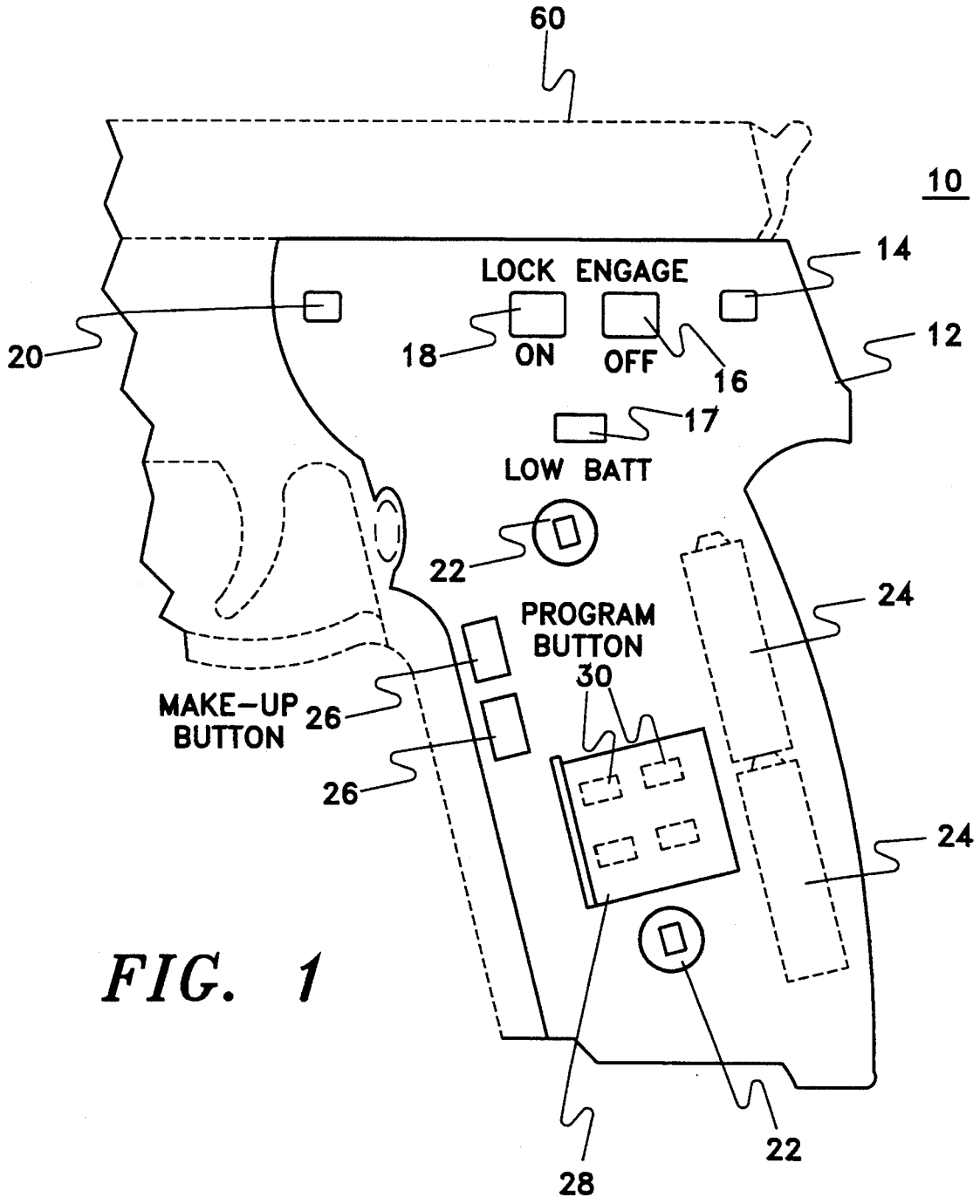
FIG. 1 is a side view of the lock and target authentication apparatus in place on a typical semi-automatic handgun.

FIG. 1 is a side view of invention 10 in place on handgun 60. While a typical semi-automatic handgun is shown, any handgun or rifle which is discussed in FIG. 6 can be easily adapted as long as the weapon is fitted with handgrips. Handgrip 12 is designed to replace the factory supplied handgrips (not shown). Handgrip 12 is preferably fabricated from durable plastic, sized to match the factory grips.

The layout of the various parts of invention 10 is adjusted to fit in accordance with the particular handgrip that is being utilized. However, the following description is typical and is preferable for the SIG Model P228.

Figure 2:
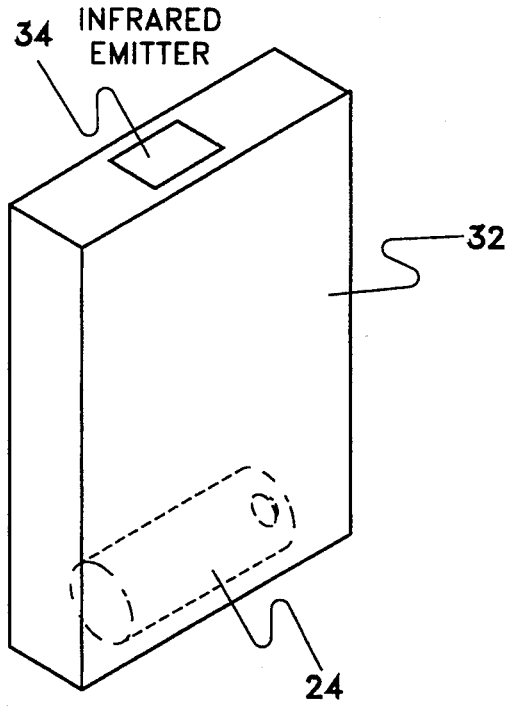
FIG. 2 is an isometric view of the remote infra red control transmitter.
Figure 3:
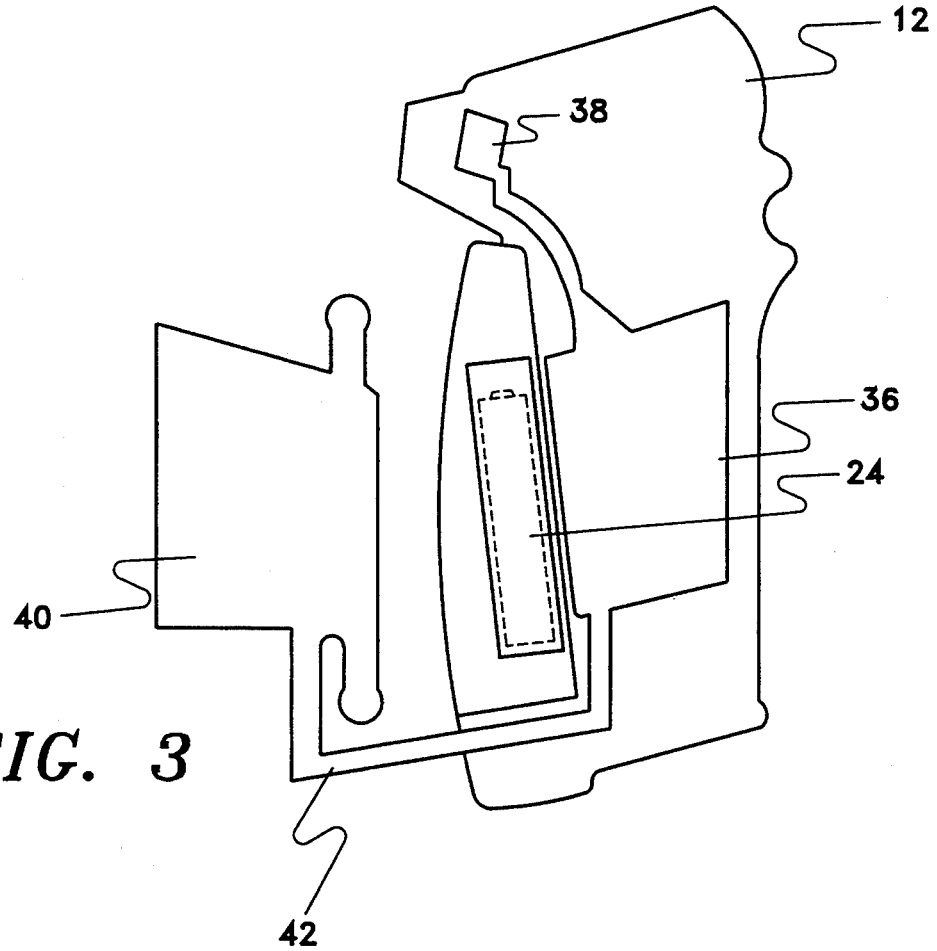
FIG. 3 is an inside view of one of the handgrips of the apparatus showing the flexible membrane circuit board and battery in place.

Fitted within grip 12 are leds 16–18 which are connected to a flexible membrane circuit (shown in FIGS. 2 and 3). The flexible membrane circuit is fitted within a recess of grip. Led 18 is preferably the color "green" to indicate that weapon 60 is in a safe or lock on condition, while led 16 is preferably the color "red" to indicate that weapon 60 is in a "off" or firing position. Low battery indicator led 17 is preferably the color "orange" so that no confusion can result that might occur if the typical color "red" were chosen as the led to indicate that battery needed to be replaced.

Grip 12 is preferably fastened to weapon 60 using special headed machine screws 22 instead of the screws that held the factory installed grips in place. In this manner, someone who wishes to defeat invention 10 would not be able to remove the grips and thus remove the safety locking and target authentication abilities of a weapon equipped with the invention.

Figure 4:
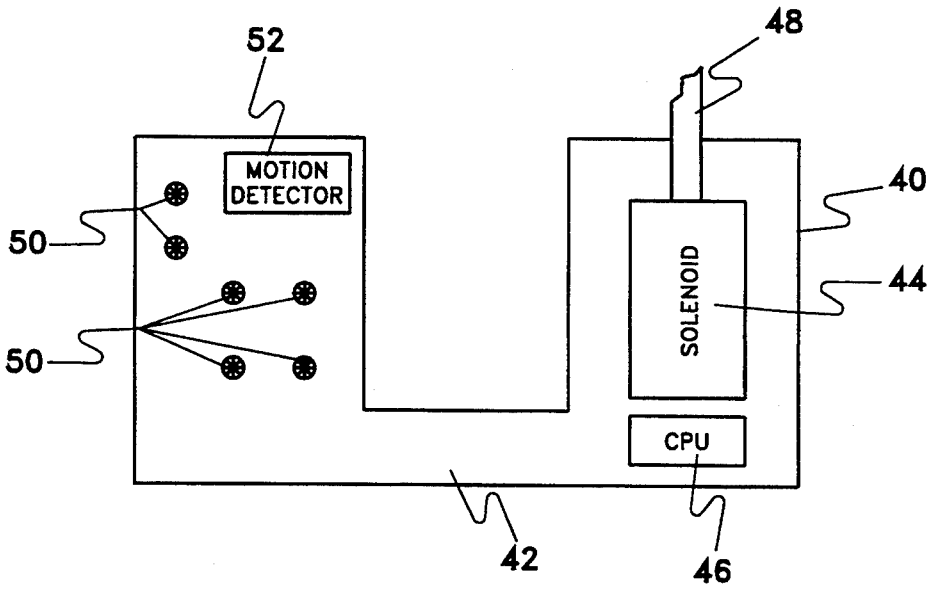
FIG. 4 is a detail of the flexible membrane circuit board with the solenoid attached.

Buttons 26 are preferably rubber buttons having a conductive rubber puck underneath which is aligned with and makes connection with one connection 50 of left-hand flexible membrane circuit 36 (shown in FIG. 4). While this type of activation is preferred since it can be made waterproof and is extremely durable, it is not essential to the operation of the invention and other switches and buttons can be substituted.

Shown in phantom are batteries 24 which are also contained with grip 12. Batteries 24 are preferably AA which are easily obtainable and inexpensive. Two batteries 24 are shown, however, other sizes and quantity could be easily substituted without effecting the overall performance of invention 10.

Infra red detector 14 is used to detect a signal from a remote infra red transmitter described below and Infra red emitter 20 is used to transmit a unique programmable infra red signal to one or more other weapons also equipped with the invention. Door 28 covers buttons 30 which are used to program invention 10 as will be discussed below.

FIG. 2 is an isometric view of the remote infra red control transmitter 32. Transmitter 32 and the corresponding detector 14 utilize circuitry well known in the art, typical of that used to remote control television sets and other electronic equipment. An infra red signal is transmitted to weapon 60 via infra red emitter 34. Transmitter 32 is self contained and is powered by battery 24.

FIG. 3 is an inside view of handgrip 12 showing left-hand portion flexible membrane circuit 36 in place and right hand portion 40 connected by circuit strip 42. Right hand portion 40 would be held within the matching right handgrip (not shown). As noted, battery 24 (in this embodiment, just one battery is utilized) can easily be fit within grip 12. Connection 38 connects led 16–18 to the circuitry.

FIG. 4 is a detail of flexible membrane circuit board 36, 40, and 42 showing solenoid 44 attached. A steel plate (not shown) may be added to the handgrip behind circuit 40 for strength and rigidity. Rod 48 of solenoid 44 is used to lock the weapon and prevent it from firing. Central processing unit (CPU) 46 is preferably a chip, well known in the art, that is attached to the board and controls the operation of invention 10 which will be discussed below. Connection points 50, as discussed above, are used to contact wake-up buttons 26 and program buttons 30.

Associated with CPU 46 is timing circuitry that turns the unit off if nothing is happening for a pre-selected time, preferably 5–10 minutes so that the batteries are not wasted. Motion detector 52, well known in the art, is connected to the flexible membrane circuit board so that the weapon can detect when it is being moved and turn itself on. The unit can also be turned on when either one or both buttons 26 are pushed.

Figure 5:
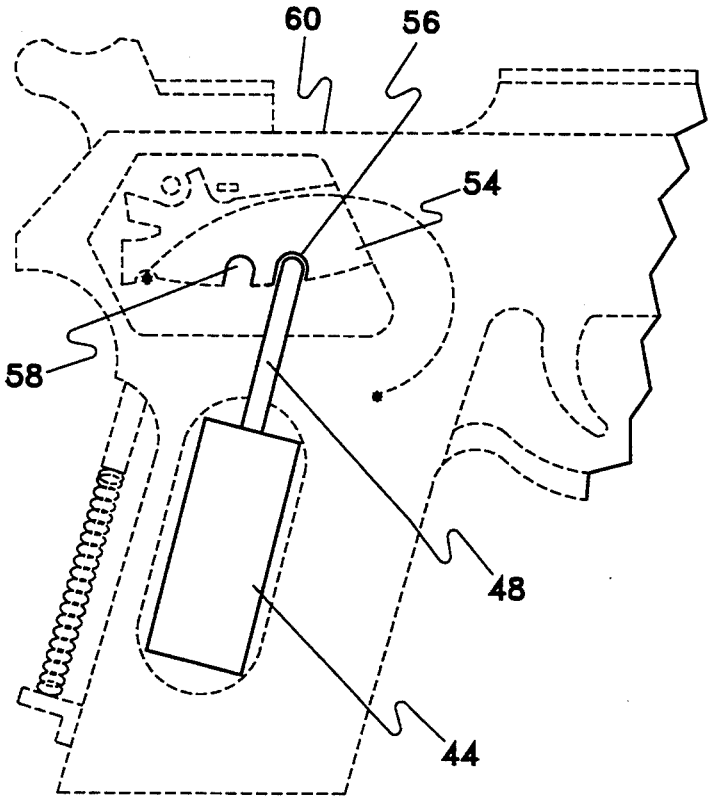
FIG. 5 is a detailed view showing the solenoid locking assembly locking the trigger bar of a typical semi-automatic handgun.

FIG. 5 is a detailed view showing solenoid 44 and rod 48 locking weapon 60. The only modification to weapon 60 that is required other than changing the handgrips is to provide two notches 56 and 58 in trigger bar 54 and weapon 60 which can be successfully locked and unlocked by invention 10. Notches 56 and 58 are required since weapon 60 is a double action firearm and thus must be able to be locked either with the hammer down or in a hammer back position.

Figure 6:
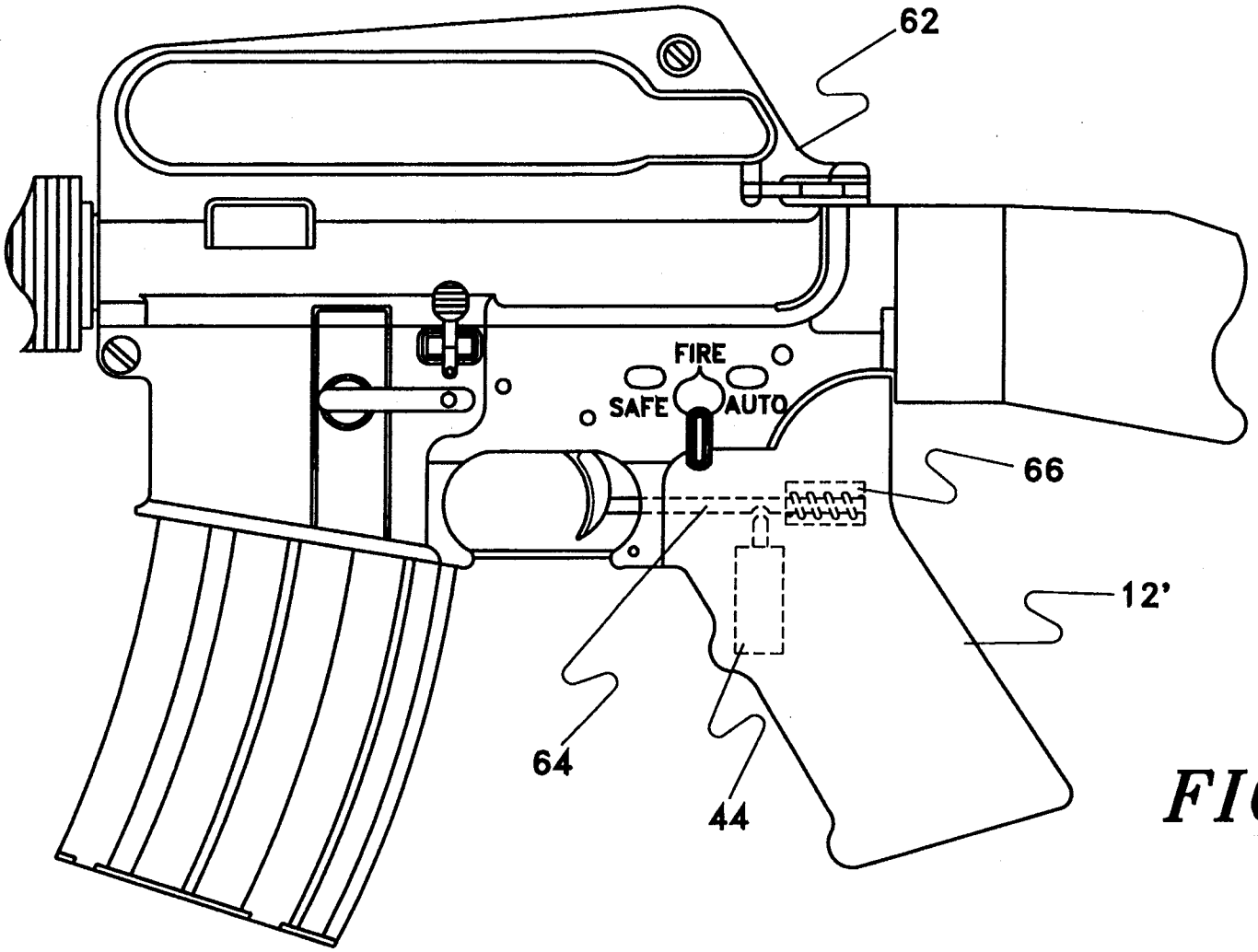
FIG. 6 is a detailed view showing the solenoid locking assembly locking the trigger of a military M-16.

As an example of how invention 10 can be retrofitted to any weapon that utilizes handgrips is shown in FIG. 6. In this application, invention 10 is fitted within the handgrips of weapon 62, for example, an M-16. The only modification of weapon 62 necessary to enable invention 10 to lock and unlock weapon 62 is the addition of locking rod 64 and spring 66.

In operation, weapon 60 or 62 is always in the locked position unless the weapon receives the proper signal from remote transmitter 32. Preferably, transmitter 32 would transmit a signal via infra red emitter 34 that is as unique to that particular weapon as its serial number. However, that is not essential and invention 10 can function extremely well if the transmitted signal has a substantial number of variations to prevent unauthorized firing.

Invention 10 is described using infra red transmitters and receivers, however, any electromagnetic signal such a radio waves could be used as long as significant numbers of variations were available for coding so that unauthorized personnel could not easily unlock the weapon and fire it.

Once detector 14 receives the proper signal as determined by CPU 46, CPU 46 activates solenoid 44 which releases rod 48 and the weapon can be fired.

To utilize the target authentication feature of invention 10, each weapon that may be fired at the same time in the same law enforcement or military action would be programmed via buttons 30 with a pre-determined code. Since the apparatus is easily programmed, this code could be changed daily if necessary in the event of a security breach. Once the operation has begun, emitter 20 would send out a "friendly" signal that could be detected by each weapon so equipped. This signal could also be sent via a laser sight apparatus such as disclosed by this inventor in U.S. patent application Ser. Nos. 08/073,766 and 08/089,889. In such cases, emitter 20 would not be used. Instead, the invention would be directly connected to the laser sighting apparatus which would impress a signal on the sighting signal that was indicative of a "friend".

Once a weapon receives a signal from another "friendly" weapon pointing at it, the unit over rides the unlock signal that has been given by remote 32 and temporarily locks the weapon so that it cannot be fired at the "friend". However, if the weapon receives a signal from a weapon equipped with a laser sight that does not have the proper coded signal, the weapon is not locked and can be fired provided it has been previously unlocked by remote 32.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A lock and target authenticating apparatus for a weapon having a trigger that when pulled activates a discharge assembly causing said weapon to discharge, said apparatus comprising:

self-contained, remote transmitter means, located at a distance from said weapon, for emitting a unique signal that corresponds only to said weapon;

sensing means for detecting the signal emitted by said emitter means, wherein said sensing means is attached to said weapon;

locking means, connected to the discharge assembly of said firearm, for preventing the activation of said weapon when said trigger is pulled;

central processing means, connected to said sensing means and said locking means, for evaluating the signal received by said sensing means to verify that is corresponds to only that weapon internal transmitting means, connected to said central processing means, for sending a unique selectable authentication signal wherein when said authentication signal is detected by a different weapon equipped with said apparatus via its sensing means, said central processing means of said different weapon causes said locking means of said different weapon to lock which cannot be overridden by said self-contained, remote transmitter means corresponding to said different weapon as long as said authentication signal is being detected;

wherein said central processing means causes said locking means to unlock when the signal received by said sensing means is verified.

2. The lock and target authenticating apparatus of claim 1 further comprising:

code input means, connected to said central processing means, for selectively changing said authentication signal.

3. The lock and target authenticating apparatus of claim 2 further comprising:

a power supply, attached to said weapon, said power supply providing electrical power to said apparatus, and wherein said central processing means further comprises power saving means for turning off said power supply after a pre-selected period of inactivity.

4. The lock and target authenticating apparatus of claim 3 wherein said central processing means further comprises:

motion detection means for turning on said power supply once said weapon is moved a predetermined amount.

5. The lock and target authenticating apparatus of claim 3 further comprising wake-up means, attached to said weapon, for sending a signal to said central processing means such that said power supply is turned on.

* * * * *